US006604313B1

(12) United States Patent
Kress

(10) Patent No.: US 6,604,313 B1
(45) Date of Patent: Aug. 12, 2003

(54) GUN LOCKING DEVICE AND METHOD FOR DISABLING A FIREARM

(76) Inventor: Kenneth I. Kress, One Partridge La., Huntington, NY (US) 11743

( * ) Notice: Subject to any disclaimer, the term of this patent is extended or adjusted under 35 U.S.C. 154(b) by 0 days.

(21) Appl. No.: 10/155,351

(22) Filed: May 24, 2002

(51) Int. Cl.[7] ..... F41A 17/00
(52) U.S. Cl. ..... 42/70.11
(58) Field of Search ..... 42/70.11

(56) References Cited

U.S. PATENT DOCUMENTS

| | | | | | |
|---|---|---|---|---|---|
| 2,327,334 | A | | 8/1943 | Parker | 42/1 |
| 2,478,098 | A | | 8/1949 | Hansen | 42/1 |
| 2,479,107 | A | | 8/1949 | Garretson | 42/70 |
| 2,763,081 | A | | 9/1956 | Huckabee | 42/1 |
| 2,887,807 | A | | 5/1959 | Santangelo | 42/1 |
| 2,985,979 | A | | 5/1961 | Doyle et al. | 42/1 |
| 3,137,957 | A | | 6/1964 | Ingalls | 42/1 |
| 3,708,901 | A | | 1/1973 | Wolter | 42/1 |
| 3,710,490 | A | | 1/1973 | Cornett et al. | 42/1 |
| 3,720,014 | A | | 3/1973 | Goodrich | 42/1 |
| 3,768,189 | A | | 10/1973 | Goodrich | 42/1 |
| 4,224,753 | A | | 9/1980 | Bielman | 42/1 |
| 4,398,366 | A | | 8/1983 | Wernicki | 42/1 |
| 4,512,099 | A | * | 4/1985 | Mathew | 42/70.11 |
| 4,969,284 | A | | 11/1990 | Healey et al. | 42/70.11 |
| 4,999,940 | A | * | 3/1991 | Madden | 42/70.11 |
| 5,001,854 | A | | 3/1991 | Derman | 42/70.11 |
| 5,038,508 | A | | 8/1991 | Brown | 42/70.11 |
| 5,048,211 | A | * | 9/1991 | Hepp | 42/70.11 |
| 5,239,767 | A | | 8/1993 | Briley, Jr. et al. | 42/70.11 |
| 5,241,770 | A | | 9/1993 | Lambert | 42/70.11 |
| 5,289,653 | A | | 3/1994 | Szebeni et al. | 42/70.11 |
| 5,357,704 | A | | 10/1994 | Benkovic | 42/70.11 |
| 5,488,794 | A | * | 2/1996 | Arrequin | 42/70.11 |
| 5,491,918 | A | | 2/1996 | Elmstedt | 42/70.11 |
| 5,664,358 | A | | 9/1997 | Haber et al. | 42/70.11 |
| 6,308,540 | B1 | * | 10/2001 | Lee | 70/58 |
| 6,382,002 | B1 | * | 5/2002 | Chen | 70/202 |
| 6,393,750 | B1 | * | 5/2002 | Rossini et al. | 42/70.11 |
| 6,442,881 | B1 | * | 9/2002 | Kellerman | 42/70.11 |
| 2001/0034961 | A1 | * | 11/2001 | Hickerson | 42/70.11 |

* cited by examiner

*Primary Examiner*—Michael J. Carone
*Assistant Examiner*—Denise Buckley
(74) *Attorney, Agent, or Firm*—Collard & Roe, P.C.

(57) ABSTRACT

A gun locking device for a firearm includes a flexible cable, a dummy cartridge attached to the first end of the cable, a lock core attached to the second end of the cable, a lock collar having a bore adapted to be disposed over the lock collar, and a lock. In one embodiment, the lock core has a casing with at least one circumferential groove, and the lock collar has an opening extending therethrough adapted to be disposed over the circumferential groove. A portion of the lock extends through the opening of the lock collar to restrain movement of the lock care and the lock collar relative to each other.

10 Claims, 6 Drawing Sheets

GUN LOCKING DEVICE AND METHOD FOR DISABLING A FIREARM

BACKGROUND OF THE INVENTION

1. Field of the Invention

The present invention relates to gun locking devices and more particularly to a gun locking device and method for disabling a firearm such as pistols, rifles and shotguns.

2. The Prior Art

At the present time, a large variety of gun locking devices are known. These devices have a number of disadvantages. Many of these devices use a rigid rod or cause damage to the firearm, or are easily circumvented, expensive or otherwise unsatisfactory.

SUMMARY OF THE INVENTION

A gun locking device for a firearm and a method for disabling a firearm is provided. In one aspect, the device including a flexible cable having a first end and a second end, a dummy cartridge attached to the first end of the cable, a lock core attached to the second end of the cable, a lock collar having an internal bore adapted to be disposed over the lock core, and a lock having a portion extending through the opening of the lock collar to restrain movement of the lock core and the lock collar relative to each other.

The dummy cartridge has a casing dimensioned to correspond with a round of ammunition for the firearm. The dummy cartridge includes a circumferential rim having a diameter larger than the inside diameter of the breech of the firearm. The rim is adapted to be engaged by the eject pawl of the firearm's bolt mechanism.

The lock core has a casing with at least one circumferential groove. An opening extending through the lock collar is adapted to be disposed over the lock core groove.

In another aspect, the device includes a lock core having a casing with a hexagonal portion and a bore with an internal thread. A lock collar having a portion of reduced diameter with an internal hexagonal bore is adapted to be disposed over the lock core to restrain rotational movement of the lock core and the lock collar relative to each other. The device also includes a cylinder lock having a portion including an external thread adapted to engage the internal thread of the lock core to cause relative movement between the cylinder lock and the lock core and thereby effect relative movement between the cylinder lock and the lock collar.

In a further aspect, a method is provided for disabling a firearm having a chamber, an elongated barrel having first and second ends, a breech having an inside diameter, and a bolt mechanism including an eject pawl for a round of ammunition for the fire arm. In accordance with this aspect, a dummy cartridge assembly is provided. The dummy cartridge assembly includes a flexible cable having a first end and a second end, a dummy cartridge attached to the first end of the cable, and a lock core attached to the second end of the cable. The dummy cartridge has a casing dimensioned to correspond with the round of ammunition for the firearm and includes a circumferential rim having a diameter larger than the inside diameter of the breech of the firearm and adapted to be engaged by the eject pawl of the bolt mechanism. The lock core has a casing with at least one circumferential groove.

The dummy cartridge assembly is inserted into the breech and up the barrel of the firearm until the lock core is protruding from the first end of the firearm. The bolt mechanism of the firearm is then closed to engage the dummy cartridge and hold the dummy cartridge assembly in place.

A lock collar is disposed over the lock core. The lock collar has an internal bore and an opening extending through the lock collar. Alternatively, a lock collar assembly including a lock collar and a bushing may be used. The lock collar has an external threaded portion, and the bushing has a bore with an internal thread engaging the external threaded portion of the lock collar.

In disposing the lock collar assembly over the lock core, the opening of the lock collar is aligned with the circumferential groove of the lock core. A portion of a lock is then inserted through the opening of the lock collar to restrain movement of the lock core and the lock collar relative to each other. If present, the bushing is then rotated relative to the lock collar to effect relative movement between the bushing and the lock collar and tension the cable within the barrel of the firearm. The bushing serves to tension the cable; however, the bushing may be eliminated, and the lock would function equally as well without such tension on the cable.

In another aspect, the lock core of the dummy cartridge assembly has a hexagonal portion and a bore with an internal thread. The dummy cartridge assembly is inserted into the breech and up the barrel of the firearm until the lock core is protruding from the first end of the firearm. The bolt mechanism of the firearm is then closed to engage the dummy cartridge and hold the dummy cartridge assembly in place.

A lock collar having a portion of reduced diameter with an internal hexagonal bore corresponding to the hexagonal portion of the lock core is disposed over the lock core to align the internal hexagonal bore of the lock collar with the hexagonal portion of the lock core. Rotational movement of the lock core and the lock collar is thereby restrained relative to each other.

The lock collar contains a cylinder lock having a portion including an external thread is then inserted into the lock core to engage the internal thread of the lock core. The external thread of the cylinder lock is then rotated to cause relative movement between the cylinder lock and the lock core and thereby effect relative movement between the cylinder lock and the lock collar, securing the lock collar to the barrel of the firearm.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
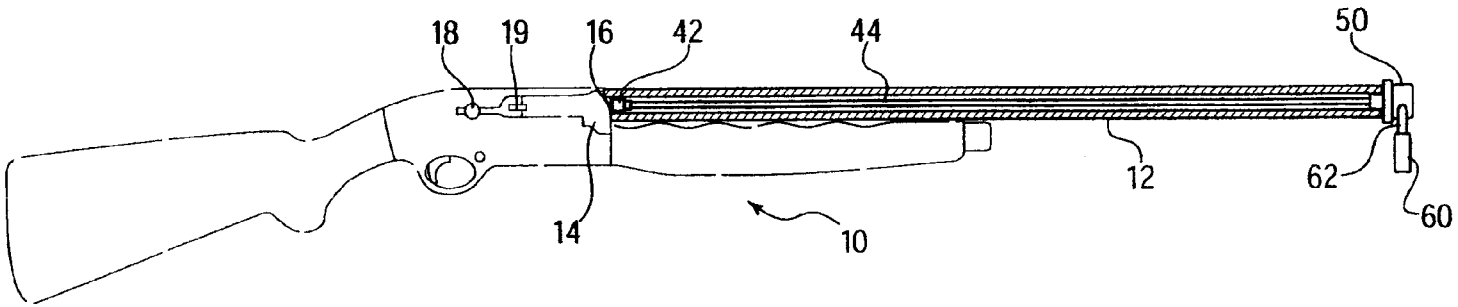
FIG. 1 is a longitudinal cross-sectional view of a rifle or shotgun with a first embodiment of the gun locking device locked in place.
Figure 2:
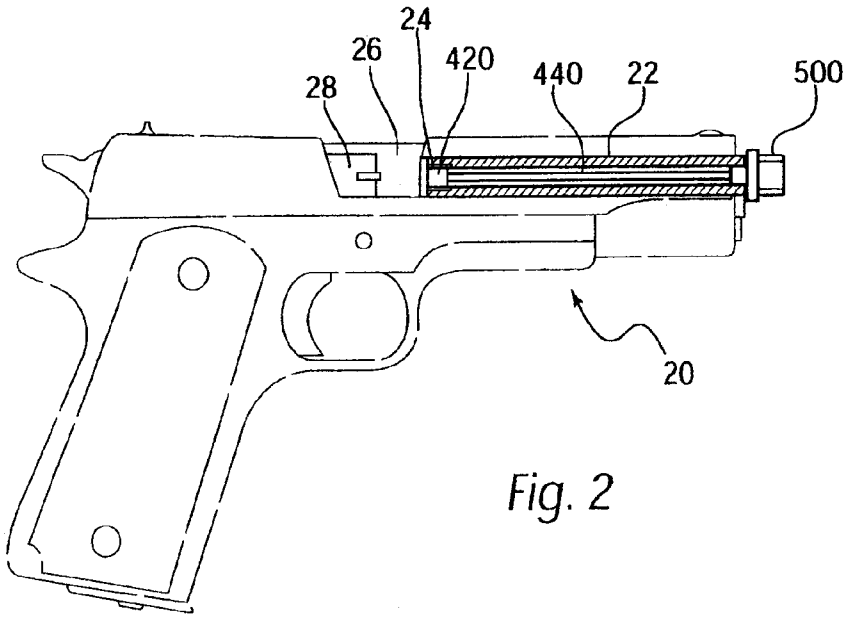
FIG. 2 is a longitudinal cross-sectional view of a handgun with a second embodiment of the gun locking device locked in place.

Turning now in detail to the drawings, FIGS. 1–2 show first and second embodiments of the gun lock installed respectively on a rifle 10 and a handgun 20. As shown in FIG. 1, rifle 10 has a barrel 12, a chamber 14, a breech 16 having an inside diameter, and a bolt mechanism 18 including an eject pawl 19 for a round of ammunition for the particular caliber of firearm. Similarly, handgun 20 shown in FIG. 2 has a barrel 22, a chamber 24, a breech 26, and a bolt mechanism 28. Although there are different sizes for each type of firearm, each embodiment of the gun lock will work in any type of firearm except for a revolver.

Figure 3:
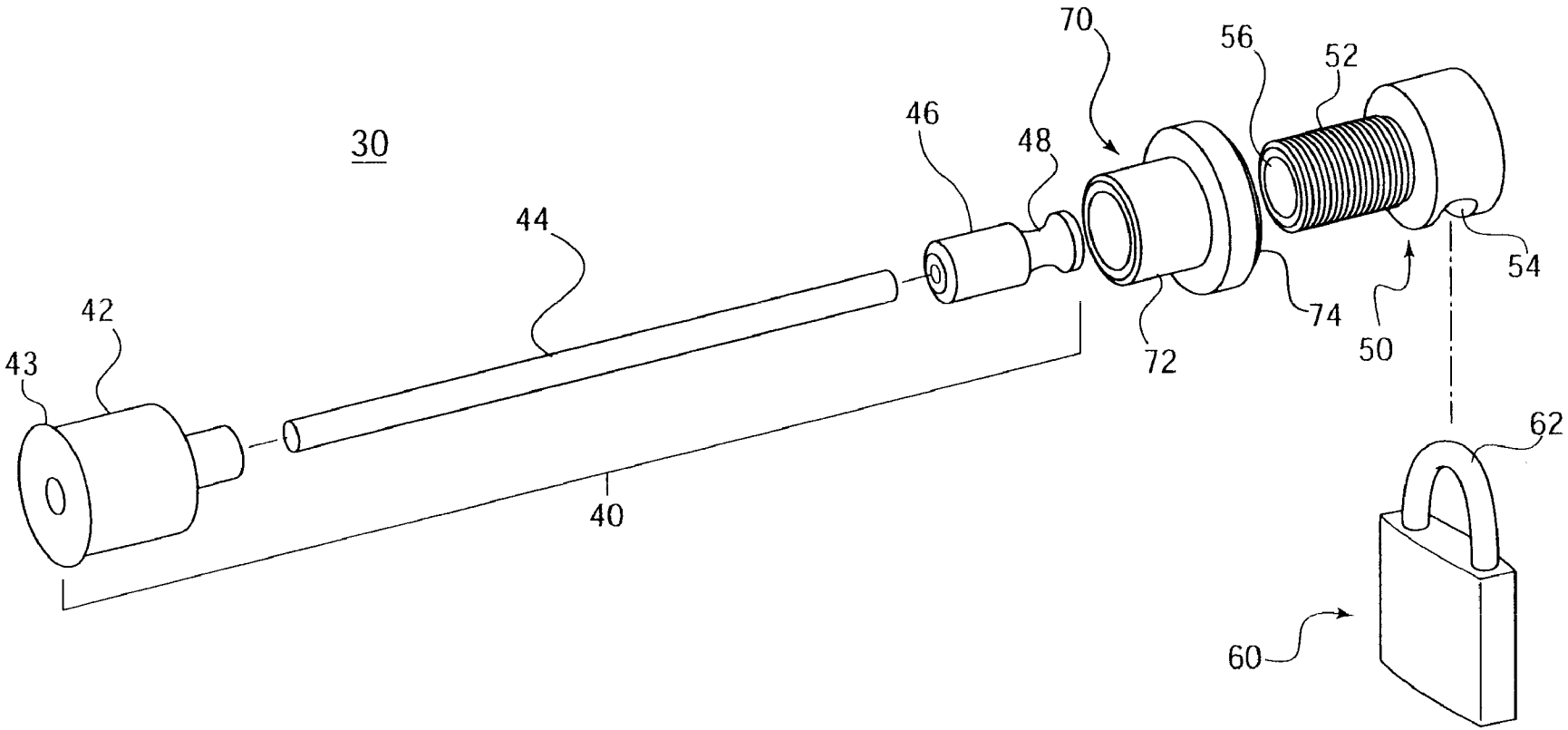
FIG. 3 is a perspective exploded view of the embodiment of FIG. 1.

Referring now to FIG. 3, a gun locking device of the first embodiment is shown. Gun locking device 30 uses a dummy cartridge cable assembly 40 which, as shown in FIG. 1, is inserted into the weapon's barrel 12 through the chamber 14, and a lock collar 50 that is locked onto dummy cartridge cable assembly 40 at the barrel end of the weapon with a lock such as padlock 60 with hasp 62. Lock collar 50 is preferably made of a material hardened to RC 50–60 to prevent cutting with a hacksaw. In addition, because a portion of lock collar 50 is inside the barrel of the weapon, access to the cable is prevented. This arrangement represents an improvement over prior designs in which the cable protrudes from the end of the barrel and is easily cut.

Dummy cartridge cable assembly 40 includes a dummy cartridge 42, a flexible cable 44, and a lock core 46 which can be mated to a plurality of locking mechanisms. Dummy cartridge 42 is on one end of cable 44 and lock core 46 is on the opposite end of cable 44. To accommodate weapons of various calibers and barrel lengths, different size dummy cartridges and cable lengths may be used to match the requirements of most available firearms.

Dummy cartridge 42 has a casing dimensioned to correspond with the round of ammunition for the firearm. In other words, dummy cartridge 42 is fabricated to the same shape and critical dimensions as the brass casing of a bullet for the caliber of the intended firearm so that it will fit exactly into the chamber of the firearm and can be held in place with the bolt of the firearm until the cable is locked. Dummy cartridge 42 has a circumferential rim 43 having a diameter larger than the inside diameter of the breech of the firearm and is adapted to be engaged by the eject pawl of the bolt mechanism.

Preferably, cable 44 is made from flexible steel or metal and is permanently attached to dummy cartridge 42 on the first or barrel end side of cable 44. The length of cable 44 is determined by the length of the barrel of the firearm. The second or opposite end of cable 44 is preferably permanently attached to lock core 46. Lock core 46 will mate with the external lock collar 50 which is secured in place by lock 60 which preferably is a standard "hasp" type lock. Lock core 46 has an area of reduced diameter or groove 48 which lock collar 50 will mate with.

Lock collar 50 has an internal bore 56 adapted to be disposed over lock core 46 and an opening 54 extending through lock collar 50 adapted to be disposed over circumferential groove 48 of lock core 46. Preferably lock collar 50 includes an external threaded portion 52 which engages a bushing 70, preferably made of plastic, having a portion 72 of reduced diameter adapted to fit within the barrel of the firearm. Bushing 70 has a bore 74 with an internal thread (not shown) adapted to engage external threaded portion 52 of lock collar 50.

In use dummy cartridge cable assembly 40 is slid into the breech and up the barrel of the firearm until lock core 46 is protruding from the end of the barrel. The bolt mechanism of the firearm is then closed holding dummy cartridge 42, cable 44 and lock core 46 in place. The eject pawl, in the bolt mechanism of the firearm, will engage and hold onto rim 43 of the dummy cartridge 42 just as it does a real cartridge thus locking the bolt mechanism to dummy cartridge cable assembly 40. Lock collar 50, preferably with bushing 70 threaded thereon, is then slid over lock core 46 so that groove 48 of lock core 46 is positioned in line with through hole 54 in lock collar 50. Hasp 62 of padlock 60 is then inserted through hole 54 in lock collar 50 and groove 48 in lock core 46 and is then locked.

At this point, bushing 70, which is on threaded portion 52 of lock collar 50, is rotated to tension cable 44 and firmly hold lock collar 50 to the barrel of the firearm. Because lock collar 50 is covering the barrel end of the firearm with the threaded portion 52 of lock collar 50 protruding inside the end of the gun barrel 12 and the diameter of rim 43 of dummy cartridge 42 is larger than the inside diameter of the breech of the firearm, dummy cartridge cable assembly 40 is completely locked into place rendering the firearm harmless and preventing a round of ammunition from being chambered into the firearm. Moreover, because the pawl of the bolt mechanism of the firearm has engaged and holds onto rim 43 of dummy cartridge 42 and because dummy cartridge 42 is locked into place by the cable, the bolt can no longer be opened.

Figure 4:
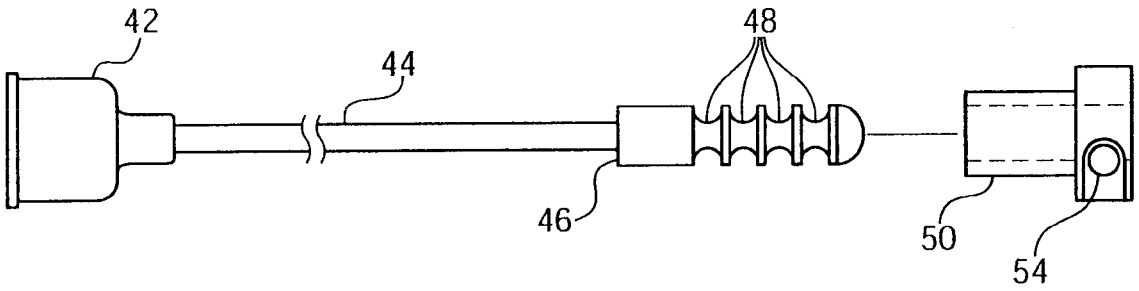
FIG. 4 is a longitudinal exploded view of a further embodiment of the gun locking device having a lock core with a plurality of circumferential grooves.

FIG. 4 shows a further embodiment in which lock core 46 has a plurality of circumferential grooves 48 for mating with lock collar 50. This arrangement allows for minor differences in gun barrel lengths by positioning lock hole 54 to align with the groove best suited for the barrel length of the particular gun.

Figure 5:
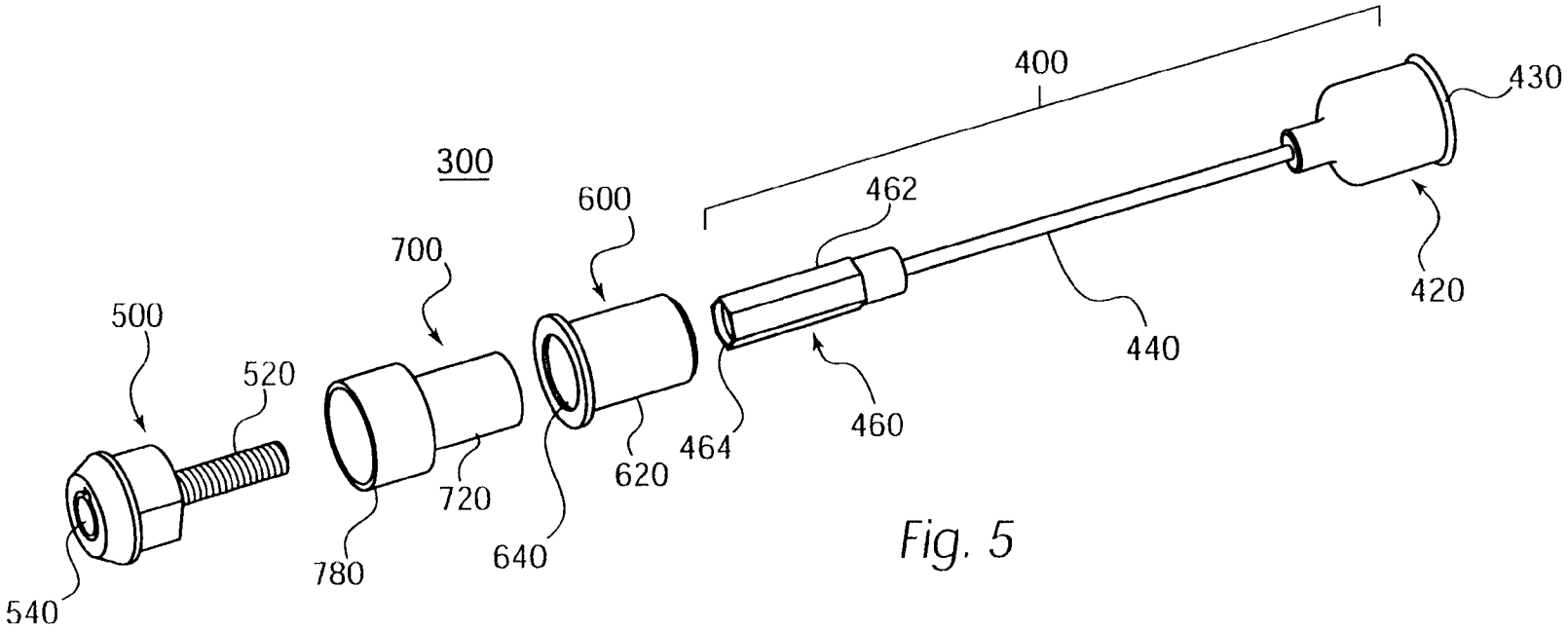
FIG. 5 is a perspective exploded view of the embodiment of FIG. 2.

Referring now to FIG. 5, a second embodiment of a gun locking device is shown. Gun locking device 300 uses a dummy cartridge cable assembly 400 which, as shown in FIG. 2, is inserted into the weapon's barrel 22 through the chamber 24, and a cylinder lock 500 that is inserted through a lock collar 700 and locked onto dummy cartridge assembly 400 at the barrel end of the weapon. Lock collar 700 is preferably made of a material hardened to RC 50–60 to prevent cutting with a hacksaw. In addition, a portion of lock collar 700 is inside the barrel of the weapon, preventing access to the cable.

Dummy cartridge cable assembly 400 includes a dummy cartridge 420, a flexible cable 440, and a lock core 460 which, like the first embodiment shown in FIG. 3, can be mated to a plurality of locking mechanisms. Dummy cartridge 420 is on one end of cable 440 and lock core 460 is on the opposite end of cable 440. As with the first embodiment, to accommodate weapons of various calibers and barrel lengths, different size dummy cartridges and cable lengths may be used to match the requirements of most available firearms.

Dummy cartridge 420 has a casing dimensioned to correspond with the round of ammunition for the firearm. As with the first embodiment, dummy cartridge 420 has a circumferential rim 430 having a diameter larger than the inside diameter of the breech of the firearm and is adapted to be engaged by the eject pawl of the bolt mechanism.

Preferably, cable 440 is made from flexible steel or metal and is permanently attached to dummy cartridge 420 on the first or barrel end side of cable 440. As with the first embodiment, the length of cable 440 is determined by the length of the barrel of the firearm. The second or opposite end of cable 440 is preferably permanently attached to lock core 460.

At least a portion of the outer casing 462 of lock core 460 is hexagonal in shape and has a bore 464 with an internal thread 466. Hexagon-shaped outer casing 462 is dimensioned so as to engage with an internal hexagonal bore 760 of lock collar 700. Internal thread 466 mates with an external thread 520 of cylinder lock 500.

Figure 8:
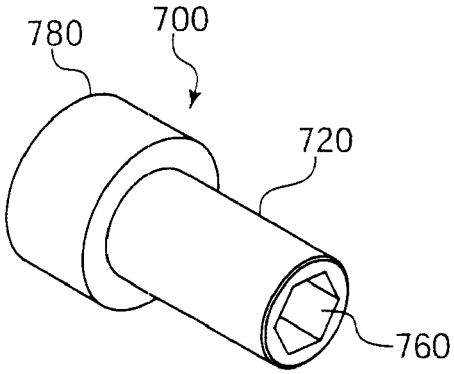
FIG. 8 is a rear perspective view of the lock collar used in the embodiment of FIG. 5.
Figure 9:
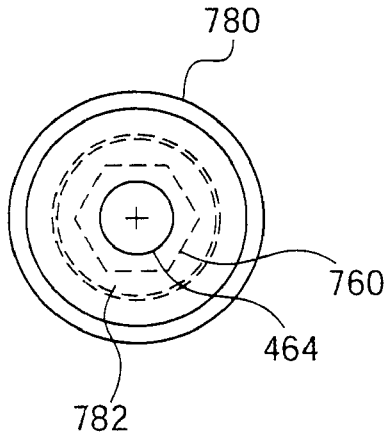
FIG. 9 is a front view of the lock collar of FIG. 8, with the lock core inserted in the rear of the lock collar.
Figure 10:
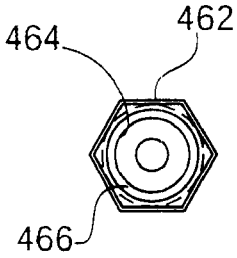
FIG. 10 is a front view of the lock core used in the embodiment of FIG. 5.

As shown in FIG. 8, lock collar 700 has a portion 720 of reduced diameter with an internal hexagonal bore 760 adapted to be disposed over the lock core 460 to restrain rotational movement of lock core 460 and lock collar 700 relative to each other. Preferably, lock collar 700 has a second portion 780 of larger diameter than the barrel of the firearm. Second portion 780 has a threaded bore 782 that engages external threads 560 on a portion of cylinder lock 500. Alternatively, cylinder lock 500 is press fit into lock collar 700 in which case external threads 560 are omitted and bore 782 is not threaded.

Preferably, reduced diameter portion 720 of lock collar 700 is press fit into the bore 640 of a sleeve 600, preferably made of plastic, having a portion 620 of reduced diameter adapted to fit within the barrel of the firearm. Sleeve 600 protects the barrel of the firearm from the hardened steel end of lock core 460. Alternatively, instead of a press fit, a threaded connection between lock collar 700 and sleeve 600 may be used. In this case, reduced diameter portion 720 of lock collar 700 has external threads, and bore 640 of sleeve 600 has an internal thread (not shown) adapted to engage external threaded portion 720 of lock collar 700.

Figure 6:
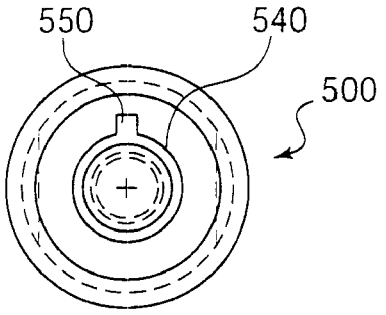
FIG. 6 is a front view of the cylinder lock used in the embodiment of FIG. 5.
Figure 7:
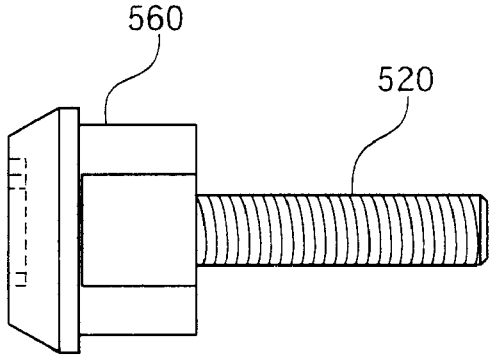
FIG. 7 is a side view of the cylinder lock of FIG. 6.

As shown in FIGS. 6 and 7, cylinder lock 500 has a first portion 520 comprising a threaded bolt and a second portion 560 of greater diameter which, as mentioned previously, also may be provided with threads. Alternatively, as also mentioned previously, second portion 560 of cylinder lock 500 may be designed to be press fit into lock collar 700. A tumbler 540 has a slot 550 adapted to receive a key whereby rotation of tumbler 540 rotates portion 520. Once inserted into lock collar 700, cylinder lock 500 is unable to be rotated. Preferably, before assembly into lock collar 700, second portion 560 may be coated with a structural adhesive or other substance inhibiting rotation. Alternatively, a pin may be added to cylinder lock 500 to prevent rotation within lock collar 700.

In use, dummy cartridge cable assembly 400 is slid into the breech and up the barrel of the firearm until lock core 460 is protruding from the end of the barrel. The bolt mechanism of the firearm is then closed holding dummy cartridge 420, cable 440 and lock core 460 in place. The eject pawl, in the bolt mechanism of the firearm, will engage and hold onto rim 430 of dummy cartridge 420 just as it does a real cartridge thus locking the bolt mechanism to dummy cartridge cable assembly 400. Lock collar 700, preferably, with sleeve 600 thereon, is then slid over lock core 460 with the hexagon shaped bore 760 aligned to the hexagon shaped outer portion 462 of lock core 460 and the reduced diameter end 20, with sleeve 600 thereon, is slid into the barrel. At this point, a key (not shown) is inserted into the tumbler 540 in cylinder lock 500 and rotated to thread the internal bolt 520 with the thread 466 in lock core 460 and turned until cylinder lock 500 is firmly secured to the barrel of the firearm. Because the assembly including cylinder lock 500, lock collar 700 and sleeve 600 is covering the barrel end of the firearm and the diameter of rim 430 of dummy cartridge 420 is larger than the inside diameter of the breech of the firearm, dummy cartridge cable assembly 400 is completely locked into place rendering the firearm harmless and preventing a round of ammunition from being chambered into the firearm. Moreover, as with the first embodiment, because the bolt mechanism of the firearm has engaged and holds onto the rim 430 of the dummy cartridge 420 and because dummy cartridge 420 is locked into place by cable 440, the bolt can no longer be opened.

Figure 11:
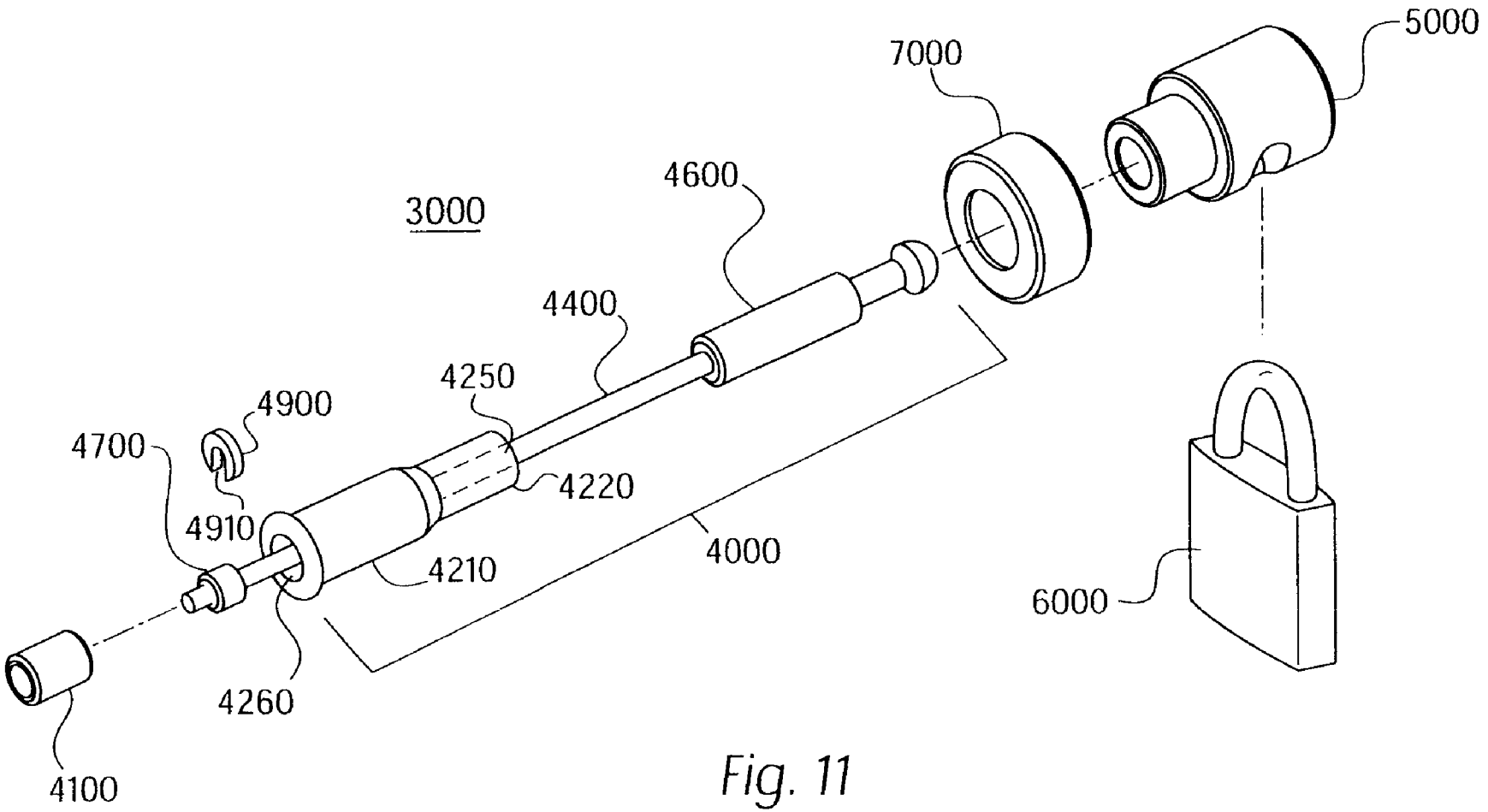
FIG. 11 is a perspective exploded view of a further embodiment of the gun locking device of the invention.

In a further embodiment shown in FIG. 11, the length of the cable may be made adjustable. In this embodiment, gun locking device 3000 uses a dummy cartridge cable assembly 4000 and a lock collar 5000. Like the embodiments discussed previously, dummy cartridge cable assembly 4000 is inserted into the weapon's barrel through the chamber and lock collar 5000 is locked onto dummy cartridge cable assembly 4000 at the barrel end of the weapon with padlock 6000. Lock collar 5000 is preferably made of a material hardened to RC 50–60 to prevent cutting with a hacksaw. In addition, a portion of lock collar 5000 is inside the barrel of the weapon, preventing access to the cable.

Dummy cartridge cable assembly 4000 includes a dummy cartridge 4200, a flexible cable 4400, and a lock core 4600 which can be mated to a plurality of locking mechanisms. Dummy cartridge 4200 has a first portion 4210 with a first bore 4260 of a first diameter and a second portion 4220 with a second bore 4250 of a second diameter. The diameter of second bore 4250 is smaller than the diameter of first bore 4260. Dummy cartridge 4200 is on one end of cable 4400 and lock core 4600 is on the opposite end of cable 4400.

Figure 12:
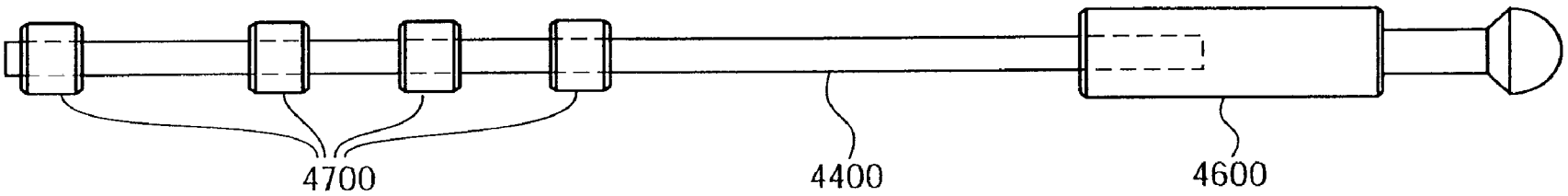
FIG. 12 is a perspective view of a portion of dummy cartridge cable assembly used in the embodiment of FIG. 11 shown without the dummy cartridge.

In order to allow for weapons with different barrel lengths there are a plurality of collars 4700 crimped onto flexible cable 4400 at several locations spaced along the length of cable 4400 as shown in FIG. 12. Preferably, each collar 4700 is made from steel and is permanently fixed onto cable 4400. Small hole or bore 4250 of dummy cartridge 4200 is on the barrel side end which is just large enough to allow each crimp collar 4700 on cable 4400 to pass through. Counterbore 4260 is on the opposite end of dummy cartridge 4200 and has a diameter just larger than the outside diameter of a lock ring 4900 preferably also made of steel. In the center of lock ring 4900 is an opening 4910 having the same diameter as that of cable 4400. Opening 4910 forms a slot of the same width as cable 4400 which extends radially to the outside diameter of cable 4400. To adjust the length of cable 4400 to match the length of the barrel of a particular firearm, slot 4910 in lock ring 4900 is inserted onto cable. 4400 in front of the particular crimp collar 4700 at the position on cable 4400 that represents the correct cable length. Cable 4400 is then cut just behind, i.e. on the outside or bolt side end of, crimp collar 4700. Dummy cartridge 4200 is then pulled rearward (to the left in FIG. 11). The diameter of first or large bore 4260 is large enough to allow lock ring 4900 on cable 4400 to pass through first bore 4260. The diameter of the second bore 4250 of dummy cartridge 4200 is small enough to prevent lock ring 4900 on cable 4400 from entering second bore 4250. Thus, when dummy cartridge 4200 is pulled rearward, crimp collar 4700, which is fixed onto cable 4400, will then pull lock ring 4900 into large bore 4260 of dummy cartridge 4200 until lock ring 4900 is stopped by smaller bore 4250 on the inside or barrel side end of dummy cartridge 4200. At this point, flexible cable 4400 can no longer be pulled out of dummy cartridge 4200 (to the right in FIG. 11). A bushing 4100, preferably made of a deformable material such as plastic, is then pushed into bore 4260 of dummy cartridge 4200 behind lock ring 4900 to retain it. The diameter of bushing 4100 is slightly larger than bore 4260 of dummy cartridge 4200 so it will fit tight and remain in place. Any force exerted in trying to remove lock assembly 3000 from the weapon will be in the opposite direction and will not be exerted on bushing 4100.

The remaining parts of this embodiment including bushing 7000, lock collar 5000, and padlock 6000 operate like the corresponding parts in the embodiment shown in FIG. 3, and the discussion with respect to that embodiment applies equally to the embodiment of FIG. 11.

While a few embodiments of the present invention have been shown and described, it is to be understood that many changes and modifications may be made thereunto without departing from the spirit and scope of the invention as defined in the appended claims.

What is claimed is:

1. A gun locking device for a firearm having a breech having an inside diameter and a bolt mechanism including an eject pawl for a round of ammunition for the firearm, said gun locking device comprising:

(a) a flexible cable having a first end and a second end;

(b) a dummy cartridge attached-to the first end of said cable, said dummy cartridge having a casing dimensioned to correspond with the round of ammunition for the firearm and including a circumferential rim having a diameter larger than the inside diameter of the breech of the firearm and adapted to be engaged by the eject pawl of the bolt mechanism;

(c) a lock core attached to the second end of said cable having a casing with at least one circumferential groove;

(d) a lock collar having an internal bore adapted to be disposed over said lock core, said lock collar having an opening extending therethrough adapted to be disposed over said at least one circumferential groove of said lock core; and (e) a lock having a portion extending through the opening of said lock collar to restrain movement of said lock core and said lock collar relative to each other;

wherein (f) said dummy cartridge has a first portion with a first bore of a first diameter and a second portion with a second bore of a second diameter, said second diameter of said second portion being smaller than said first diameter of said first portion;

(g) said cable has a length and a third diameter;

(h) said gun locking device further comprises a plurality of collars spaced along the length of said cable, said second diameter of said second bore of said dummy car-ridge being large enough to allow each collar on said cable to pass through said second bore;

(i) said gun locking device further comprises a lock ring having an opening corresponding to said third diameter of said cable adapted to be disposed on said cable, said first diameter of said first bore of said dummy cartridge being large enough to allow said lock ring on said cable to pass through said first bore, said second diameter of said dummy cartridge being small enough to prevent said lock ring on said cable from entering said second bore; and (j) said gun locking device further comprises a bushing made of a deformable material adapted to be disposed tightly in said first bore.

2. The gun locking device according to claim 1 wherein the flexible cable is made from metal.

3. The gun locking device according to claim 1 wherein the flexible cable is made from steel.

4. The gun locking device according to claim 1 wherein said lock collar further comprises an external threaded portion and said gun locking device further comprises a bushing having a bore with an internal thread adapted to engage the external threaded portion of said lock collar.

5. The gun locking device according to claim 1 wherein said lock core has a plurality of circumferential grooves.

6. A gun locking device for a firearm having a breech having an inside diameter and a bolt mechanism including an eject pawl for a round of ammunition for the firearm, said gun locking device comprising:

(a) a flexible cable having a first end and a second end;

(b) a dummy cartridge attached to the first end of said cable, said dummy cartridge having a casing dimensioned to correspond with the round of ammunition for the firearm and including a circumferential rim having a diameter larger than the inside diameter of the breech of the firearm and adapted to be engaged by the eject pawl of the bolt mechanism;

(c) a lock core attached to the second end of said cable having a casing with a hexagonal portion and a bore with an internal thread;

(d) a lock collar having a portion of reduced diameter with an internal hexagonal bore adapted to be disposed over said lock core to restrain rotational movement of said lock core and said lock collar relative to each other; and (e) a cylinder lock having a portion comprising an external thread adapted to engage the internal thread of said lock core to cause relative movement between said cylinder lock and said lock core and thereby effect relative movement between said cylinder lock and said lock collar.

7. The gun locking device according to claim 6 wherein the flexible cable is made from metal.

8. The gun locking device according to claim 6 wherein the flexible cable is made from steel.

9. The gun locking device according to claim 6 wherein the internal hexagonal bore of said lock collar has an internal thread and said cylinder lock has a second portion having an external thread adapted to engage the internal thread of said lock collar.

10. A method for disabling a firearm having a chamber, an elongated barrel having first and second ends, a breech having an inside diameter and a bolt mechanism including an eject pawl for a round of ammunition for the firearm, which comprises the steps of:

(a) providing a dummy cartridge assembly comprising a flexible cable having a first end and a second end, a dummy cartridge attached to the first end of said cable, and a lock core attached to the second end of said cable, said dummy cartridge having a casing dimensioned to correspond with the round of ammunition for the firearm and including a circumferential rim having a diameter larger than the inside diameter of the breech of the firearm and adapted to be engaged by the eject pawl of the bolt mechanism, said lock core having a hexagonal portion and a bore with an internal thread;

(b) inserting the dummy cartridge assembly into the breech and up the barrel of the firearm until the lock core is protruding from the first end of the firearm;

(c) closing the bolt mechanism of the firearm to engage the dummy cartridge and hold the dummy cartridge assembly in place;

(d) providing a lock collar having a portion of reduced diameter with an internal hexagonal bore corresponding to the hexagonal portion of the lock core;

(e) disposing the lock collar over the lock core to align the internal hexagonal bore of the lock collar with the hexagonal portion of the lock core to restrain rotational movement of the lock core and the lock collar relative to each other;

(f) inserting a cylinder lock having a portion comprising an external thread into the lock core to engage the internal thread of the lock core; and (g) rotating the external thread of the cylinder lock to cause relative movement between the cylinder lock and the lock core and thereby effect relative movement between the cylinder lock and the lock collar and secure the lock collar to the barrel of the firearm.

* * * * *

UNITED STATES PATENT AND TRADEMARK OFFICE

CERTIFICATE OF CORRECTION

PATENT NO. : 6,604,313 B1
DATED : August 12, 2003
INVENTOR(S) : Kress

It is certified that error appears in the above-identified patent and that said Letters Patent is hereby corrected as shown below:

Column 7,
Line 66, "car-ridge" should read -- cartridge --.

Signed and Sealed this

Sixteenth Day of December, 2003

JAMES E. ROGAN
*Director of the United States Patent and Trademark Office*